US012807283B2

(12) United States Patent
Widmark

(10) Patent No.: US 12,807,283 B2
(45) Date of Patent: Nov. 24, 2026

(54) SEQUENTIAL CONTROL OF MULTIPLE SMALLER GYRO STABILIZERS

(71) Applicant: Humphree AB, Gothenburg (SE)

(72) Inventor: Christer Widmark, Partille (SE)

(73) Assignee: Humphree AB, Gothenburg (SE)

( * ) Notice: Subject to any disclaimer, the term of this patent is extended or adjusted under 35 U.S.C. 154(b) by 152 days.

(21) Appl. No.: 18/988,007

(22) Filed: Dec. 19, 2024

(65) Prior Publication Data

US 2025/0214685 A1 Jul. 3, 2025

(30) Foreign Application Priority Data

Dec. 29, 2023 (EP) ..... 23220772

(51) Int. Cl.
*B63B 39/04* (2006.01)

(52) U.S. Cl.
CPC ..... *B63B 39/04* (2013.01)

(58) Field of Classification Search
CPC ..... B63B 39/04
USPC ..... 114/122
See application file for complete search history.

(56) References Cited

U.S. PATENT DOCUMENTS

2014/0017083 A1 1/2014 Pineda Amo
2017/0219347 A1* 8/2017 Veto ..... B64G 1/421

FOREIGN PATENT DOCUMENTS

CN 211663417 U 10/2020
CN 114954825 A 8/2022
GB 2470961 A 12/2010

OTHER PUBLICATIONS

Extended European Search Report dated Jun. 13, 2024 in corresponding European Patent Application No. 23220772.0. 9 pages.

* cited by examiner

*Primary Examiner* — Stephen P Avila
(74) *Attorney, Agent, or Firm* — Jeffri A. Kaminski; Venable LLP

(57) ABSTRACT

A computer system comprising processing circuitry configured to:

control a set of gyro stabilizers, said set of gyro stabilizers comprising at least two gyro stabilizers, attached to a same marine vessel. The processing circuitry is adapted to provide control data to the control system of each gyro stabilizer in said set of gyro stabilizers to establish a control procedure such that, at each one of a plurality of different time instances of the control procedure, said set of gyro stabilizers comprises at least one non-active gyro stabilizer and at least one active gyro stabilizer. Each passive gyro stabilizer is controlled by the control system such that the passive gyro stabilizer is prevented from rotating around its precession axis, and each active gyro stabilizer is controlled by the control system such that the active gyro stabilizer is allowed to rotate around its precession axis.

15 Claims, 2 Drawing Sheets

SEQUENTIAL CONTROL OF MULTIPLE SMALLER GYRO STABILIZERS

TECHNICAL FIELD

The disclosure relates generally to gyro stabilization of a marine vessel, such as a ship, a floating platform, or a floating wind turbine. In particular aspects, the disclosure relates to a method of controlling multiple gyro stabilizers to achieve improved stabilization performance.

The disclosure can be applied to any marine vessel, such as a ship, a floating platform, or a floating wind turbine.

BACKGROUND

A marine vessels, such as a ship, may experience roll along a longitudinal axis of the marine vessel, typically showing as a rolling motion back and forth between port and starboard roll. Weather conditions, such as wind sea conditions, may induce rolling motion of the marine vessel. Typically, each marine vessel has a natural roll frequency and thus a natural roll period, depending for example on the size, weight, and center of gravity of the marine vessel, and on a distribution of cargo and persons on board the marine vessel. Half the natural roll period corresponds to a change in roll from one side to the other, such as from starboard to port or vice versa. Roll, yaw or pitch motion can not only be induced by waves but also from a propulsion, control surface or sudden loading conditions on the vessel itself. Gyro stabilizer are reacting to angular changes such as roll, yaw and pitch rate.

Roll may for example be mitigated using a gyro stabilizer system comprising a gyro stabilizer configured to use a precession effect of the gyro stabilizer to provide a momentum counteracting roll of the marine vessel. Larger marine vessels require a larger gyro stabilizer, which increases space requirements for installation of the gyro stabilizer system.

Some gyro stabilization systems use a plurality of smaller gyro stabilizers together providing a larger stabilization capacity.

Smaller gyro stabilizers tend to precess faster than larger gyro stabilizers and may thus provide a roll-counteracting torque over only a limited portion of the time of the roll movement of the marine vessel.

Accordingly, there is a need for an improved gyro stabilization system capable of counteracting roll movement/roll rate of the marine vessel with low roll accelerations throughout the roll movement of the marine vessel, thus increasing comfort for persons onboard said marine vessels and reducing roll induced acceleration and stress on components mounted on the marine vessel.

SUMMARY

According to a first aspect of the disclosure, a computer system is provided, said computer system comprising processing circuitry configured to:

control a set of gyro stabilizers, said set of gyro stabilizers comprising at least two gyro stabilizers, attached to a same marine vessel, such as a ship, a floating platform, or a floating wind turbine.

Each gyro stabilizer in said set of gyro stabilizers comprises:

a) a gyro housing comprising a flywheel adapted to rotate around a spin axis, wherein said gyro housing is adapted to rotate around a precession axis, said spin axis and said precession axis being perpendicular, and b) a control system for controlling rotation of said gyro housing around said precession axis in response to control data from the processing circuitry.

An angle between the precession axes of any two gyro stabilizers in said set of gyro stabilizers is less than 20 degrees. Preferably, the precession axes of any two gyro stabilizers in said set of gyro stabilizers are parallel or co-linear.

The processing circuitry is adapted to provide control data to the control system of each gyro stabilizer in said set of gyro stabilizers to establish a control procedure such that, at each one of a plurality of different time instances of the control procedure, said set of gyro stabilizers comprises at least one non-active gyro stabilizer and at least one active gyro stabilizer, wherein the at least one non-active gyro stabilizer and the at least one active gyro stabilizer are different gyro stabilizers at different time instances of said control procedure, wherein: each passive gyro stabilizer is controlled by the control system such that the passive gyro stabilizer is prevented from rotating around its precession axis, and each active gyro stabilizer is controlled by the control system such that the active gyro stabilizer is allowed to rotate around its precession axis.

It should be understood that an activation of a gyro stabilizer amounts to setting it active (allowing precession), and that a deactivation of a gyro stabilizer amounts to setting it non-active (preventing precession).

The provision of a plurality of gyro stabilizers enables each gyro stabilizer to be smaller as compared to the use of a single larger gyro stabilizer. This in turn enables improved flexibility as to where in the marine vessel the gyro stabilizer is installed, making design of the marine vessel easier and enabling easier retrofit of gyro stabilizers. By controlling the set of gyro stabilizers such that not all gyro stabilizers are able to precess at the same time, the torque at any given time during the control procedure is limited to the available torque of the currently active gyro stabilizer(s) and other gyro stabilizers are able to precess at another portion of the roll period, thereby forcing the gyro stabilizers to precess over a larger period of time than would be possible if all gyro stabilizers would be enabled at a same time. This in turn enables a more even application of torque to counteract roll of the marine vessel.

A marine vessel equipped with only a single controlled gyro stabilizer would likely need to have its gyro stabilizer controlled/dampened to fit the vessel roll period and thereby limits its precession rate such that maximum precession angle is not reached before the end of half the roll period, i.e. not before the roll motion shifts direction; Reduced precession rate leads to reduced torque and thereby less stabilizing torque. However, a smaller gyro stabilizer is able to reach a higher stabilizing torque faster after its activation, thereby enabling a higher stabilizing torque earlier. Similarly, the use of a plurality of smaller gyro stabilizers also enables provision of a higher stabilizing torque at the end of the (half) roll period, as compared to a single larger gyro stabilizer.

Optionally in some examples, including in at least one preferred example, the control procedure is such that the gyro stabilizers of the set of gyro stabilizers are sequentially activated during said control procedure.

Sequential activation means that there is a time-difference between the times at which each respective gyro stabilizer of the set of gyro stabilizers is activated (precession is enabled). However, sequential activation does not mean that only one gyro is active at a given time, i.e. a second gyro stabilizer may be activated before an already active gyro stabilizer has completed precession.

Optionally in some examples, including in at least one preferred example, the control procedure comprises:

deactivating each respective gyro stabilizer of said set of gyro stabilizers in response to a precession angle of the respective gyro stabilizer reaching a predetermined maximum precession angle, or deactivating all gyro stabilizers of said set of gyro stabilizers at a predicted or actual end time of a roll movement determined by the processing circuitry based on at least roll movement data of a roll movement sensor of said marine vessel.

At precession of each gyro stabilizer, the counter torque provided by the gyro stabilizer for mitigating roll will vary with the precession angle and precession rate of the gyro stabilizer, typically measured from a neutral position with the spin axis vertical at zero roll of the marine vessel, to a positive or negative precession angle depending on the roll direction of the marine vessel. The precession torque is largest when the precession angle is 0 degrees, and diminishes as the precession angle approaches 90 degrees. Typically, the gyros are designed for precession angles in the range of +−70 degrees and when a gyro stabilizer reaches the outer limits of that range the gyro stabilizer may be deactivated.

Optionally in some examples, including in at least one preferred example the control procedure is initiated based on an input.

The input may be a manually triggered signal/data, or a signal/data provided by a computer system, for example based on sensor information indicating start of a roll movement to be mitigated by the set of gyro stabilizers.

Optionally in some examples, including in at least one preferred example the processing circuitry is configured to:

determine roll movement data based on data from a roll movement sensor of the marine vessel, and determine a predicted or actual start time of a roll movement based on at least the roll movement data.

The roll movement sensor may be any suitable sensor capable of determining at least a roll angle of the marine vessel, but preferably also capable of determining roll movement acceleration about at least the longitudinal axis of the marine vessel.

The roll movement has a start when a roll movement (having a roll rate) of the marine vessel starts rolling about a longitudinal axis of the marine vessel towards a first side of the longitudinal axis or towards a second side on the opposite side of the longitudinal axis, and has an end when the roll movement changes roll direction back towards the second side or first side, respectively.

The control procedure is initiated at the start time or a predetermined time offset before or after said start time.

Preferably, the computer system uses the roll movement data to dynamically determine the roll period which is to be mitigated by the set of gyro stabilizers, and to determine at what time the control procedure is to be started and to determine when and for how long each gyro stabilizer should be active.

Optionally in some examples, including in at least one preferred example, a respective time of activation of each respective gyro stabilizer of said set of gyro stabilizers is adapted to achieve one or more time-overlaps in which a plurality of gyro stabilizers of said set of gyro stabilizers are simultaneously active.

In each time overlap two or more gyro stabilizers are active, thus ensuring a higher torque will be available in the time-overlap and mitigating any loss of stabilizing torque which could otherwise occur.

Optionally in some examples, including in at least one preferred example, the respective time of activation of each respective gyro stabilizer is adapted such that, throughout the control procedure, any one or more activated gyro stabilizers together provide a total stabilizing torque above a predetermined torque threshold.

Optionally in some examples, including in at least one preferred example, the processing circuitry is further configured obtain a natural roll period of the marine vessel based on the roll movement data or based on input data, and to control the length of the control procedure such that it corresponds to half the natural roll period.

Optionally in some examples, including in at least one preferred example, the processing circuitry is adapted to control precession rate of any active gyro stabilizer.

Precession rate of a gyro stabilizer may be performed according to any method known in the art, such as by using hydraulics or a servo motor to limit or increase movement rate of the respective gyro stabilizer, thus affecting the counter torque provided by the gyro stabilizer for mitigating roll. Thus, controlled precession enables improved control of the extent in time a gyro stabilizer is active, and also enables improved control of the momentum provided by the gyro stabilizer.

Optionally in some examples, including in at least one preferred example, the processing circuitry is configured obtain a natural roll period of the marine vessel based on the roll movement data or based on input data, and to control precession rate of any enabled gyro stabilizers such that the active gyro stabilizers provide a total stabilizing torque above a predetermined torque limit throughout the control procedure.

According to a second aspect, a marine vessel is provided, such as a ship, a floating platform or a floating wind turbine. The marine vessel comprises a set of gyro stabilizers, said set comprising at least two gyro stabilizers, attached to the marine vessel. Each gyro stabilizer in said set of gyro stabilizers comprises:

a gyro housing comprising a flywheel adapted to rotate around a spin axis wherein said gyro housing is adapted to rotate around a precession axis, said spin axis and said precession axis being perpendicular, and a control system for controlling rotation of said gyro housing around said precession axis in response to control data from the processing circuitry.

An angle between the precession axes of any two gyro stabilizers in said set of gyro stabilizers is less than 20 degrees, preferably the precession axes of any two gyro stabilizers in said set of gyro stabilizers are parallel or co-linear.

An angle between the respective precession axis of any one of the gyro stabilizers of said set of gyro stabilizers and a longitudinal axis of the marine vessel is 80-100 degrees, preferably 90 degrees.

The marine vessel further comprises a computer system according the disclosure above, also defined in any one of examples 1-10.

Optionally in some examples, including in at least one preferred example, the set of gyro stabilizers may be positioned beside each other at a plane extending transversely to the longitudinal axis of the marine vessel.

According to a third aspect, a computer program product is provided, said computer program product comprising program code for performing, when executed by the processing circuitry the above-described control procedure, also defined in any one of examples 1-10.

According to a fourth aspect, a non-transitory computer-readable storage medium is provided, said storage medium comprising instructions, which when executed by the processing circuitry cause the processing circuitry to perform the method of any of examples 1-10.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

There are also disclosed herein computer systems, control units, code modules, computer-implemented methods, computer readable media, and computer program products associated with the above discussed technical benefits.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

A marine vessels, such as a ship, may experience roll along a longitudinal axis of the marine vessel, typically showing as a rolling motion back and forth between port and starboard roll angles. Weather conditions and sea conditions may induce rolling motion of the marine vessel. Typically, each marine vessel has a natural roll frequency and thus a natural roll period. Half the natural roll period corresponds to a change in roll from one side to the other, such as from starboard to port or vice versa.

Roll may for example be mitigated using a gyro stabilizer system comprising a gyro stabilizer configured to use a precession effect of the gyro stabilizer to provide a momentum counteracting roll of the marine vessel. Larger marine vessels require a larger gyro stabilizer, which increases space requirements for installation of the gyro stabilizer system. Some gyro stabilization systems use a plurality of smaller gyro stabilizers together providing a larger stabilization capacity.

Smaller gyro stabilizers tend to precess faster than larger gyro stabilizers and may thus provide the roll-counteracting torque over only a limited portion of the roll movement of the marine vessel thereby providing a higher stabilization torque earlier on during a roll.

Accordingly, there is a need for an improved gyro stabilization system capable of sufficiently counteract roll of the marine vessel with low roll accelerations throughout the roll movement of the marine vessel, thus increasing comfort for persons onboard said marine vessels and reducing roll induced acceleration and stress on components mounted on the marine vessel.

Figure 1:
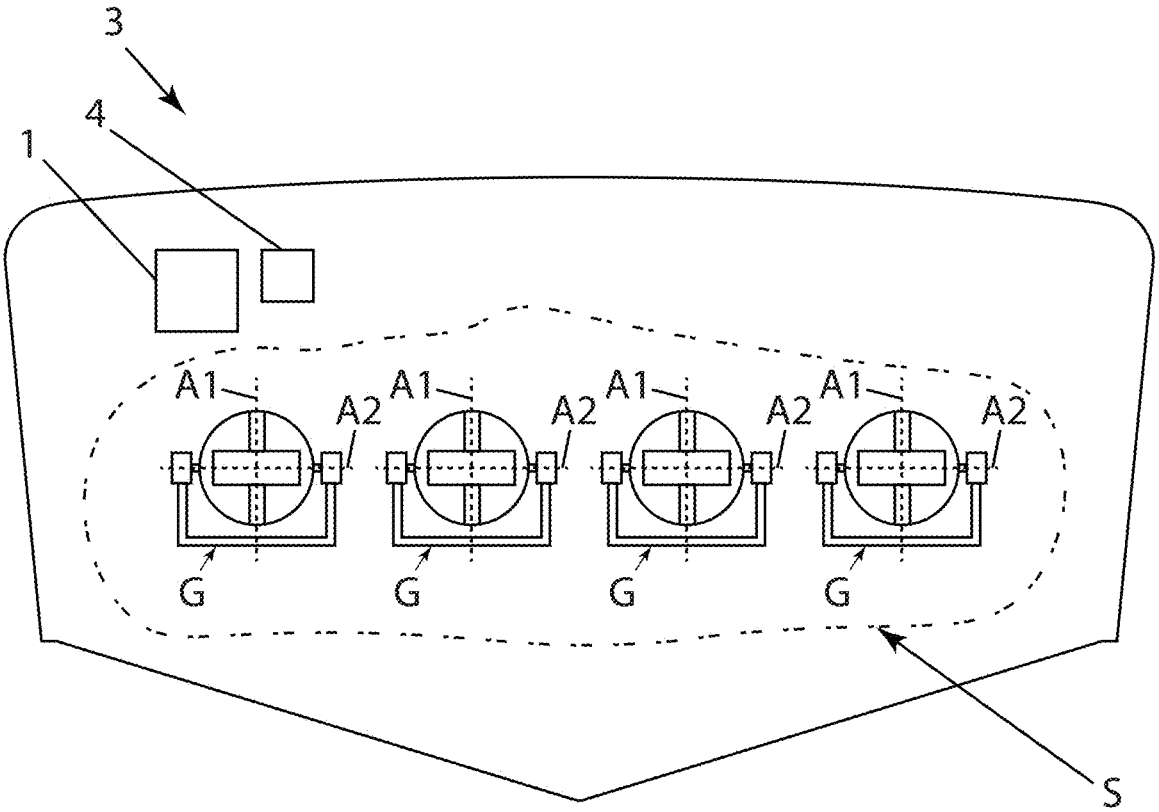
FIG. 1 shows a schematic rear view of a marine vessel according to a first example.

The marine vessel of FIG. 1 mitigates these problems using a plurality of gyro stabilizers and a computer system implementing a specific control procedure activating only some, i.e. one or more, but not all, of the gyro stabilizers at a time (thus deactivating other gyro stabilizers by preventing precession).

The marine vessel of FIG. 1 is a ship, but could in other examples/embodiments be any marine vessel 1 susceptible of roll, such as a floating platform or a floating wind turbine.

The marine vessel 1 comprises a set of gyro stabilizers G, said set comprising at least two gyro stabilizers G—in this embodiment four gyro stabilizers, attached to the marine vessel 1, wherein each gyro stabilizer G in said set S of gyro stabilizers comprises:

- a gyro housing comprising a flywheel adapted to rotate around a spin axis A1 wherein said gyro housing is adapted to rotate around a precession axis A2, said spin axis A1 and said precession axis A2 being perpendicular, and
- a control system for controlling rotation of said gyro housing around said precession axis A2 in response to control data from the processing circuitry 2.

An angle between the precession axes of any two gyro stabilizers G in said set S of gyro stabilizers is less than 20 degrees, preferably the precession axes A2 of any two gyro stabilizers G in said set S of gyro stabilizers are parallel or co-linear.

Also, an angle between the respective precession axis A2 of any one of the gyro stabilizers G of said set S of gyro stabilizers and a longitudinal axis L of the marine vessel is 80-100 degrees, preferably 90 degrees.

The marine vessel 3 further comprises a computer system 1 according to any one of examples 1-10. An example of the computer system 1 is shown in FIG. 3 and further discussed below.

Figure 2:
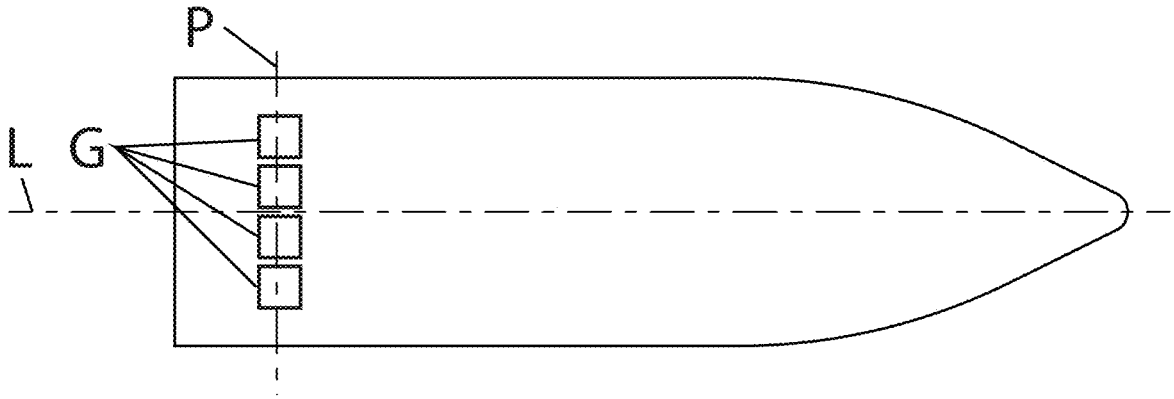
FIG. 2 shows a schematic top view of the marine vessel also shown in FIG. 1.

As shown in FIG. 1, the marine vessel 3 set S of gyro stabilizers may be positioned beside each other at a plane P (see FIG. 2) extending transversely to the longitudinal axis L of the marine vessel 3. In other embodiments, the gyro stabilizers G may have any suitable position on the marine vessel 3.

Each gyro stabilizer G may comprise a servo motor for control of precession about the precession axis A2 of the respective gyro stabilizer G. In other embodiments, the servo motor may alternatively be omitted and a brake controlled by the computer system 1 used instead, or the servo motor may be replaced by a hydraulic or mechanical brake or a hydraulically powered motor/actuator.

Figure 3:
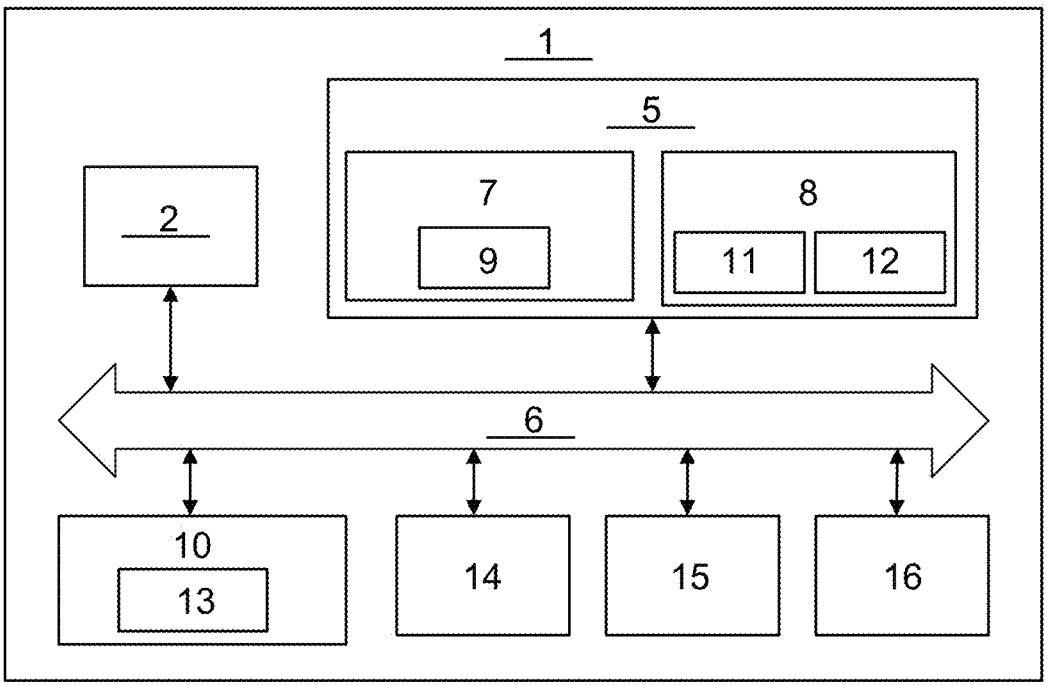
FIG. 3 shows a schematic diagram of an exemplary computer system for implementing examples disclosed herein, according to an example.

FIG. 3 is a schematic diagram of a computer system 1 for implementing examples disclosed herein. The computer system 1 is adapted to execute instructions from a computer-readable medium to perform these and/or any of the functions or processing described herein. The computer system 1 may be connected (e.g., networked) to other machines in a LAN (Local Area Network), LIN (Local Interconnect Network), automotive network communication protocol (e.g., FlexRay), an intranet, an extranet, or the Internet. While only a single device is illustrated, the computer system 1 may include any collection of devices that individually or jointly execute a set (or multiple sets) of instructions to perform any one or more of the methodologies discussed herein. Accordingly, any reference in the disclosure and/or claims to a computer system, computing system, computer device, computing device, control system, control unit, electronic control unit (ECU), processor device, processing circuitry, etc., includes reference to one or more such devices to individually or jointly execute a set (or multiple sets) of instructions to perform any one or more of the methodologies discussed herein. For example, control system may include a single control unit or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 1 may comprise at least one computing device or electronic device capable of including firmware, hardware, and/or executing software instructions to implement the functionality described herein. The computer system 1 may include processing circuitry 2 (e.g., processing circuitry including one or more processor devices or control units), a memory 5, and a system bus 6. The computer system 1 may include at least one computing device having the processing circuitry 2. The system bus 6 provides an interface for system components including, but not limited to, the memory 5 and the processing circuitry 2. The processing circuitry 2 may include any number of hardware components for conducting data or signal processing or for executing computer code stored in memory 5.

The processing circuitry 2 may, for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processing circuitry 2 may further include computer executable code that controls operation of the programmable device.

The system bus 6 may be any of several types of bus structures that may further interconnect to a memory bus (with or without a memory controller), a peripheral bus, and/or a local bus using any of a variety of bus architectures. The memory 5 may be one or more devices for storing data and/or computer code for completing or facilitating methods described herein. The memory 5 may include database components, object code components, script components, or other types of information structure for supporting the various activities herein. Any distributed or local memory device may be utilized with the systems and methods of this description. The memory 5 may be communicably connected to the processing circuitry 2 (e.g., via a circuit or any other wired, wireless, or network connection) and may include computer code for executing one or more processes described herein. The memory 5 may include non-volatile memory 7 (e.g., read-only memory (ROM), erasable programmable read-only memory (EPROM), electrically erasable programmable read-only memory (EEPROM), etc.), and volatile memory 8 (e.g., random-access memory (RAM)), or any other medium which can be used to carry or store desired program code in the form of machine-executable instructions or data structures and which can be accessed by a computer or other machine with processing circuitry 2. A basic input/output system (BIOS) 9 may be stored in the non-volatile memory 7 and can include the basic routines that help to transfer information between elements within the computer system 1.

The computer system 1 may further include or be coupled to a non-transitory computer-readable storage medium such as the storage device 10, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 10 and other drives associated with computer-readable media and computer-usable media may provide non-volatile storage of data, data structures, computer-executable instructions, and the like. Computer-code which is hard or soft coded may be provided in the form of one or more modules. The module(s) can be implemented as software and/or hard-coded in circuitry to implement the functionality described herein in whole or in part. The modules may be stored in the storage device 10 and/or in the volatile memory 8, which may include an operating system 11 and/or one or more program modules 12. All or a portion of the examples disclosed herein may be implemented as a computer program 13 stored on a transitory or non-transitory computer-usable or computer-readable storage medium (e.g., single medium or multiple media), such as the storage device 10, which includes complex programming instructions (e.g., complex computer-readable program code) to cause the processing circuitry 2 to carry out actions described herein. Thus, the computer-readable program code of the computer program 13 can comprise software instructions for implementing the functionality of the examples described herein when executed by the processing circuitry 2. In some examples, the storage device 10 may be a computer program product (e.g., readable storage medium) storing the computer program 13 thereon, where at least a portion of a computer program 13 may be loadable (e.g., into a processor) for implementing the functionality of the examples described herein when executed by the processing circuitry 2. The processing circuitry 2 may serve as a controller or control system for the computer system 1 that is to implement the functionality described herein.

The computer system 1 may include an input device interface 14 configured to receive input and selections to be communicated to the computer system 1 when executing instructions, such as from a keyboard, mouse, touch-sensitive surface, etc. Such input devices may be connected to the processing circuitry 2 through the input device interface 14 coupled to the system bus 6 but can be connected through other interfaces, such as a parallel port, an Institute of Electrical and Electronic Engineers (IEEE) 1394 serial port, a Universal Serial Bus (USB) port, an IR interface, and the like. The computer system 1 may include an output device interface 15 configured to forward output, such as to a display, a video display unit (e.g., a liquid crystal display (LCD) or a cathode ray tube (CRT)). The computer system 1 may include a communications interface 16 suitable for communicating with a network as appropriate or desired.

The operational actions described in any of the exemplary aspects herein are described to provide examples and discussion. The actions may be performed by hardware components, may be embodied in machine-executable instructions to cause a processor to perform the actions, or may be performed by a combination of hardware and software. Although a specific order of method actions may be shown or described, the order of the actions may differ. In addition, two or more actions may be performed concurrently or with partial concurrence.

Example 1. A computer system 1 comprising processing circuitry 2 configured to:

control a set S of gyro stabilizers, said set S of gyro stabilizers comprising at least two gyro stabilizers G, attached to a same marine vessel, such as a ship, a floating platform, or a floating wind turbine, wherein each gyro stabilizer G in said set S of gyro stabilizers comprises:

a) a gyro housing comprising a flywheel adapted to rotate around a spin axis A1 wherein said gyro housing is adapted to rotate around a precession axis A2, said spin axis A1 and said precession axis A2 being perpendicular, and b) a control system for controlling rotation of said gyro housing around said precession axis A2 in response to control data from the processing circuitry 2, wherein an angle between the precession axes of any two gyro stabilizers G in said set S of gyro stabilizers is less than 20 degrees, preferably the precession axes A2 of any two gyro stabilizers G in said set S of gyro stabilizers are parallel or co-linear, said processing circuitry 2 being adapted to provide control data to the control system of each gyro stabilizer G in said set S of gyro stabilizers to establish a control procedure such that, at each one of a plurality of different time instances of the control procedure, said set S of gyro stabilizers comprises at least one non-active gyro stabilizer and at least one active gyro stabilizer, wherein the at least one non-active gyro stabilizer and the at least one active gyro stabilizer are different gyro stabilizers at different time instances of said control procedure, wherein:

each passive gyro stabilizer G is controlled by the control system such that the passive gyro stabilizer G is prevented from rotating around its precession axis A2, and each active gyro stabilizer G is controlled by the control system such that the active gyro stabilizer G is allowed to rotate around its precession axis A2, an activation of a gyro stabilizer G amounts to setting it active, and a deactivation of a gyro stabilizer G amounts to setting it non-active.

Example 2. A computer system 1 according to example 1, wherein the control procedure is such that the gyro stabilizers G of the set S of gyro stabilizers are sequentially activated during said control procedure.

Example 3. A computer system 1 according to any one of examples 1-2, wherein said control procedure comprises:

deactivating each respective gyro stabilizer of said set S of gyro stabilizers in response to a precession angle of the respective gyro stabilizer G reaching a predetermined maximum precession angle, or deactivating all gyro stabilizers G of said set S of gyro stabilizers at a predicted or actual end time of a roll movement determined by the processing circuitry 2 based on at least roll movement data of a roll movement sensor 4 of said marine vessel 3.

Example 4. A computer system 1 according to any one of examples 1-3, wherein said control procedure is initiated based on an input.

Example 5. A computer system 1 according to any one of examples 1-3, wherein the processing circuitry 2 is configured to:

determine roll movement data based on data from a roll movement sensor 4 of the marine vessel 3, and determine a predicted or actual start time of a roll movement based on at least the roll movement data, said roll movement having a start when a roll movement of the marine vessel 3 starts rolling about a longitudinal axis L of the marine vessel 3 towards a first side of the longitudinal axis L or towards a second side on the opposite side of the longitudinal axis L, and having an end when the roll movement changes roll direction back towards the second side or first side, respectively, wherein said control procedure is initiated at the start time or a predetermined time offset before or after said start time.

Example 6. A computer system 1 according to any one of examples 1-5, wherein a respective time of activation of each respective gyro stabilizer G of said set S of gyro stabilizers is adapted to achieve one or more time-overlaps in which a plurality of gyro stabilizers of said set S of gyro stabilizers are simultaneously active.

Example 7. A computer system 1 according to example 6, wherein the respective time of activation of each respective gyro stabilizer G is adapted such that, throughout the control procedure, any one or more activated gyro stabilizers G together provide a total stabilizing torque above a predetermined torque threshold.

Example 8. A computer system 1 according to any one of examples 1-7, wherein the processing circuitry 2 is further configured obtain a natural roll period of the marine vessel 3 based on the roll movement data or based on input data, and to control the length of the control procedure such that it corresponds to half the natural roll period.

Example 9. A computer system 1 according to any one of examples 1-8, wherein the processing circuitry 2 is adapted to control precession rate of any active gyro stabilizer G.

Example 10. A computer system 1 according to example 9, the processing circuitry 2 is configured obtain a natural roll period of the marine vessel 3 based on the roll movement data or based on input data, and to control precession rate of any enabled gyro stabilizers G such that the active gyro stabilizers G provide a total stabilizing torque above a predetermined torque limit throughout the control procedure.

Example 11. A marine vessel 3, such as a ship, a floating platform or a floating wind turbine, said marine vessel 3 comprising a set S of gyro stabilizers, said set S comprising at least two gyro stabilizers G, attached to the marine vessel 3, wherein each gyro stabilizer G in said set S of gyro stabilizers comprises:

a gyro housing comprising a flywheel adapted to rotate around a spin axis A1 wherein said gyro housing is adapted to rotate around a precession axis A2, said spin axis A1 and said precession axis A2 being perpendicular, a control system for controlling rotation of said gyro housing around said precession axis A2 in response to control data from the processing circuitry 2, wherein an angle between the precession axes of any two gyro stabilizers G in said set S of gyro stabilizers is less than 20 degrees, preferably the precession axes of any two gyro stabilizers G in said set S of gyro stabilizers are parallel or co-linear, wherein an angle between the respective precession axis A2 of any one of the gyro stabilizers G of said set S of gyro stabilizers and a longitudinal axis L of the marine vessel 3 is 80-100 degrees, preferably 90 degrees.

said marine vessel 3 further comprising a computer system 1 according to any one of examples 1-10.

Example 12. A marine vessel 3 according to example 11, wherein the set S of gyro stabilizers are positioned beside each other at a plane extending transversely to the longitudinal axis L of the marine vessel 3.

Example 13. A marine vessel according to example 11 or 12, wherein each gyro stabilizer comprises a servo motor for control of precession about the precession axis of the respective gyro stabilizer.

Example 14. A computer program product comprising program code for performing, when executed by the processing circuitry, 2 the method of any of examples 1-10.

Example 15. A non-transitory computer-readable storage medium comprising instructions, which when executed by the processing circuitry, 2 cause the processing circuitry 2 to perform the method of any of examples 1-10.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A computer system comprising processing circuitry configured to:

control a set of gyro stabilizers, said set of gyro stabilizers comprising at least two gyro stabilizers, attached to a same marine vessel, wherein each gyro stabilizer in said set of gyro stabilizers comprises:

a) a gyro housing comprising a flywheel adapted to rotate around a spin axis wherein said gyro housing is adapted to rotate around a precession axis, said spin axis and said precession axis being perpendicular, and b) a control system for controlling rotation of said gyro housing around said precession axis in response to control data from the processing circuitry, wherein an angle between the precession axes of any two gyro stabilizers in said set of gyro stabilizers is less than 20, preferably the precession axes of any two gyro stabilizers in said set of gyro stabilizers are parallel or co-linear, said processing circuitry being adapted to provide control data to the control system of each gyro stabilizer in said set of gyro stabilizers to establish a control procedure such that, at each one of a plurality of different time instances of the control procedure, said set of gyro stabilizers comprises at least one non-active gyro stabilizer and at least one active gyro stabilizer, wherein the at least one non-active gyro stabilizer and the at least one active gyro stabilizer are different gyro stabilizers at different time instances of said control procedure, wherein:

each passive gyro stabilizer is controlled by the control system such that the passive gyro stabilizer is prevented from rotating around its precession axis, and each active gyro stabilizer is controlled by the control system such that the active gyro stabilizer is allowed to rotate around its precession axis.

2. A computer system according to claim 1, wherein the control procedure is such that the gyro stabilizers of the set of gyro stabilizers are sequentially activated during said control procedure.

3. A computer system according to claim 1, wherein said control procedure comprises:

deactivating each respective gyro stabilizer of said set of gyro stabilizers in response to a precession angle of the respective gyro stabilizer reaching a predetermined maximum precession angle, or deactivating all gyro stabilizers of said set of gyro stabilizers at a predicted or actual end time of a roll movement determined by the processing circuitry based on at least roll movement data of a roll movement sensor of said marine vessel.

4. A computer system according to claim 1, wherein said control procedure is initiated based on an input.

5. A computer system according to claim 1, wherein the processing circuitry is configured to:

determine roll movement data based on data from a roll movement sensor of the marine vessel, and determine a predicted or actual start time of a roll movement based on at least the roll movement data, said roll movement having a start when a roll movement of the marine vessel starts rolling about a longitudinal axis of the marine vessel towards a first side of the longitudinal axis or towards a second side on the opposite side of the longitudinal axis, and having an end when the roll movement changes roll direction back towards the second side or first side, respectively, wherein said control procedure is initiated at the start time or a predetermined time offset before or after said start time.

6. A computer system according to claim 1, wherein a respective time of activation of each respective gyro stabilizer of said set of gyro stabilizers is adapted to achieve one or more time-overlaps in which a plurality of gyro stabilizers of said set of gyro stabilizers are simultaneously active.

7. A computer system according to claim 6, wherein the respective time of activation of each respective gyro stabilizer is adapted such that, throughout the control procedure, any one or more activated gyro stabilizers together provide a total stabilizing torque above a predetermined torque threshold.

8. A computer system according to claim 1, wherein the processing circuitry is further configured obtain a natural roll period of the marine vessel based on the roll movement data or based on input data, and to control the length of the control procedure such that it corresponds to half the natural roll period.

9. A computer system according to claim 1, wherein the processing circuitry is adapted to control precession rate of any active gyro stabilizer.

10. A computer system according to claim 9, the processing circuitry is configured obtain a natural roll period of the marine vessel based on the roll movement data or based on input data, and to control precession rate of any enabled gyro stabilizers such that the active gyro stabilizers provide a total stabilizing torque above a predetermined torque limit throughout the control procedure.

11. A marine vessel, said marine vessel comprising a set of gyro stabilizers, said set comprising at least two gyro stabilizers, attached to the marine vessel, wherein each gyro stabilizer in said set of gyro stabilizers comprises:

a gyro housing comprising a flywheel adapted to rotate around a spin axis wherein said gyro housing is adapted to rotate around a precession axis, said spin axis and said precession axis being perpendicular, a control system for controlling rotation of said gyro housing around said precession axis in response to control data from the processing circuitry, wherein an angle between the precession axes of any two gyro stabilizers in said set of gyro stabilizers is less than 20 degrees, preferably the precession axes of any two gyro stabilizers in said set of gyro stabilizers are parallel or co-linear, wherein an angle between the respective precession axis of any one of the gyro stabilizers of said set of gyro stabilizers and a longitudinal axis of the marine vessel is 80-100 degrees, preferably 90 degrees.

said marine vessel further comprising a computer system according to claim 1.

12. A marine vessel according to claim 11, wherein the set of gyro stabilizers are positioned beside each other at a plane extending transversely to the longitudinal axis of the marine vessel.

13. A marine vessel according to claim 11, wherein each gyro stabilizer comprises a servo motor for control of precession about the precession axis of the respective gyro stabilizer.

14. A computer program product comprising program code for performing, when executed by the processing circuitry, the method of claim 1.

15. A non-transitory computer-readable storage medium comprising instructions, which when executed by the processing circuitry, cause the processing circuitry to perform the method of claim 1.

* * * * *